US006935697B2

(12) United States Patent
Conlon et al.

(10) Patent No.: US 6,935,697 B2
(45) Date of Patent: Aug. 30, 2005

(54) FOOT ELEVATING CUSHION

(75) Inventors: Jessica S. Conlon, Richmond, VA (US); Jeffrey D. Martin, Richmond, VA (US)

(73) Assignee: Carpenter Co., Richmond, VA (US)

( * ) Notice: Subject to any disclaimer, the term of this patent is extended or adjusted under 35 U.S.C. 154(b) by 64 days.

(21) Appl. No.: 10/268,913

(22) Filed: Oct. 11, 2002

(65) Prior Publication Data

US 2004/0070254 A1 Apr. 15, 2004

(51) Int. Cl.[7] ..... A47C 16/00
(52) U.S. Cl. ..... 297/423.41
(58) Field of Search ..... 297/423.41, 423.39, 297/DIG. 1, 452.27, 452.37; 5/655.9, 652, 648, 630, 632, 645

(56) References Cited

U.S. PATENT DOCUMENTS

| | | | | |
|---|---|---|---|---|
| 621,098 | A | | 3/1899 | Kelly |
| 2,375,225 | A | | 5/1945 | Herbert |
| 2,448,427 | A | * | 8/1948 | Gordon ..... 280/32.5 |
| 2,465,781 | A | | 3/1949 | Banta |
| 2,522,120 | A | | 9/1950 | Kaskey et al. |
| 2,700,779 | A | * | 2/1955 | Tolkowsky ..... 5/632 |
| 2,748,838 | A | | 6/1956 | Scholl |
| 2,839,766 | A | | 6/1958 | Hull |
| 2,878,493 | A | | 3/1959 | Delia |
| 3,124,812 | A | | 3/1964 | Milton et al. |
| 3,162,486 | A | | 12/1964 | Emery |
| 3,234,623 | A | * | 2/1966 | Rector ..... 27/21.1 |
| 3,308,489 | A | | 3/1967 | Winkler |
| 3,345,654 | A | | 10/1967 | Noble |
| 3,482,566 | A | | 12/1969 | Watkins |
| 3,505,994 | A | * | 4/1970 | Smith ..... 602/24 |
| 3,604,023 | A | | 9/1971 | Lynch |
| 4,090,268 | A | * | 5/1978 | Turner ..... 5/656 |
| 4,270,235 | A | | 6/1981 | Gutmann |
| 4,371,985 | A | | 2/1983 | Pokhis |
| 4,392,489 | A | | 7/1983 | Wagner, Sr. |
| 4,475,542 | A | * | 10/1984 | Brossard ..... 606/240 |
| 4,584,730 | A | | 4/1986 | Rajan |
| 4,736,477 | A | | 4/1988 | Moore |
| 4,805,605 | A | | 2/1989 | Glassman |
| 4,910,818 | A | | 3/1990 | Grabill et al. |
| D319,751 | S | | 9/1991 | Hoff |
| D321,562 | S | | 11/1991 | Ljungvall |
| 5,097,553 | A | | 3/1992 | Boland |
| 5,125,123 | A | * | 6/1992 | Engle ..... 5/648 |
| 5,173,979 | A | | 12/1992 | Nennhaus |
| 5,442,823 | A | * | 8/1995 | Siekman et al. ..... 5/653 |
| 5,454,993 | A | | 10/1995 | Kostich |
| 5,497,520 | A | | 3/1996 | Kunz et al. |
| 5,603,336 | A | | 2/1997 | Shepich |
| 5,745,939 | A | * | 5/1998 | Flick et al. ..... 5/648 |
| 6,065,166 | A | | 5/2000 | Sharrock et al. |
| 6,182,314 | B1 | | 2/2001 | Frydman |
| 6,349,438 | B1 | | 2/2002 | Coleman et al. |
| 6,564,407 | B1 | * | 5/2003 | Luu et al. ..... 5/654 |
| 6,640,368 | B2 | * | 11/2003 | Roston ..... 5/648 |
| 2001/0032365 | A1 | | 10/2001 | Sramek |
| 2002/0088057 | A1 | | 7/2002 | Wassilefsky |

* cited by examiner

*Primary Examiner*—Milton Nelson, Jr.

(57) ABSTRACT

An elevating foot cushion that includes an embodiment with a cushion that is preferably of a unitary foam body defining front and rear faces and left and right lateral faces and an upper leg contact surface. The upper leg contact surface has first and second laterally spaced apart leg reception areas such as recesses that extend in a leg extension direction between the front and rear faces and an intermediate foam body region extending between the spaced apart leg reception recesses. The cushion preferably has an upper leg support surface that has first and second portions which have a first support characteristic designed for supporting an individual leg, and the upper leg support surface also preferably includes a third portion having a different support characteristic than the first and second portions which is more adept at handling a higher load pair of crossed legs. This third portion is preferably an elongated recess with a different configuration than the first and second elongated leg reception recesses.

35 Claims, 5 Drawing Sheets

FOOT ELEVATING CUSHION

FIELD OF THE INVENTION

The present invention pertains to a foot elevating rest or cushion that elevates a user's feet while resting. In a preferred embodiment, the cushion is formed by a configured foam body and is suited for use both while a user is sleeping or while resting awake such as while watching TV or reading. A preferred embodiment also is designed for accommodating either a crossed leg arrangement or a non-cross legged arrangement.

BACKGROUND OF THE INVENTION

The benefits associated with elevating a person's feet include improved blood flow to desired areas. Elevating a person's feet above the level of the heart or upper body can be therapeutic in helping to decrease inflammation and swelling in the leg, foot and/or ankle region. For example, the often referenced "RICE" treatment for sprained ankles involves rest, ice, compression and elevation. Foot elevation is also a standard instruction following foot surgery and the like to reduce swelling and decrease the pain level. Foot and ankle swelling due to fluid build up is also common during pregnancy and foot elevation is often recommended. Back pain sufferers also often find relief by elevating their feet/legs with an appropriate support.

Even without an injury or swelling, individuals often find it more comfortable to have their feet elevated when lying on their back.

A variety of support pads and cushions have been advanced in the art in an effort to provide for leg elevation. A remote control variable height foot rest can be seen in U.S. Pat. No. 6,349,438 which features hydraulic members to vary the height. Of course, there is a high expense associated with a system of this type and its usage location is restricted. U.S. Pat. Nos. 5,097,533; 5,173,979 and 5,497,520 illustrate examples of leg elevation support cushions that are designed with an emphasis on supporting a bent knee in conjunction with the feet, and thus tend to be large and bulky and therefore obstructive. In addition, many of these prior art cushions fail to provide a high degree of comfort and/or proper leg positioning or maintenance.

SUMMARY OF THE INVENTION

The present invention is directed at providing a high comfort cushion which provides for foot elevational and proper leg/foot positioning relative to the cushion for a variety of user positions. The present invention is also designed to maintain a high comfort level and proper leg/foot positioning for a variety of leg/foot placements commonly used by a person including a supine position (on the back) lying position. This includes both crossed legs and non-crossed legs where the legs are separated apart in the ankle region to some extent. The enhancement in leg/foot placement is facilitated by dimensioned cavities or recesses in the supporting surface which are designed to comfortably support and retain the portion of the body received therein. This includes, in a preferred embodiment of the invention, a pair of recesses that are dimensioned widthwise and depth wise to comfortably accommodate the user's leg(s). The cushion's depth is preferably designed to support a portion of the leg extending (in the lengthwise direction) between the ankle/heel border region (e.g., the lower end of the Achilles) and the lower end/border region of the calf (e.g., the fleshy mass formed chiefly by the gastrocnemius muscle at the back of the leg ( below the knee)). In the widthwise direction the side width of recesses formed in the upper surface of the main body of the cushion are designed to receive the leg (or legs if the cross leg arrangement is involved) comfortably (e.g., with contact on the side walls and some degree of compression of the receiving material but far removed from a bottomed out state). This sizing can be based on a universal for all (adult and child) setting, or a universal for adult in use with a universal child size, or a series of different sizes (e.g. 3 to 7) designed for various dimensioned legs.

The present invention is also designed to elevate a person's legs to facilitate blood flow in desired areas of the body while avoiding too high a positioning which can lead to discomfort.

DETAILED DESCRIPTION

Figure 1:
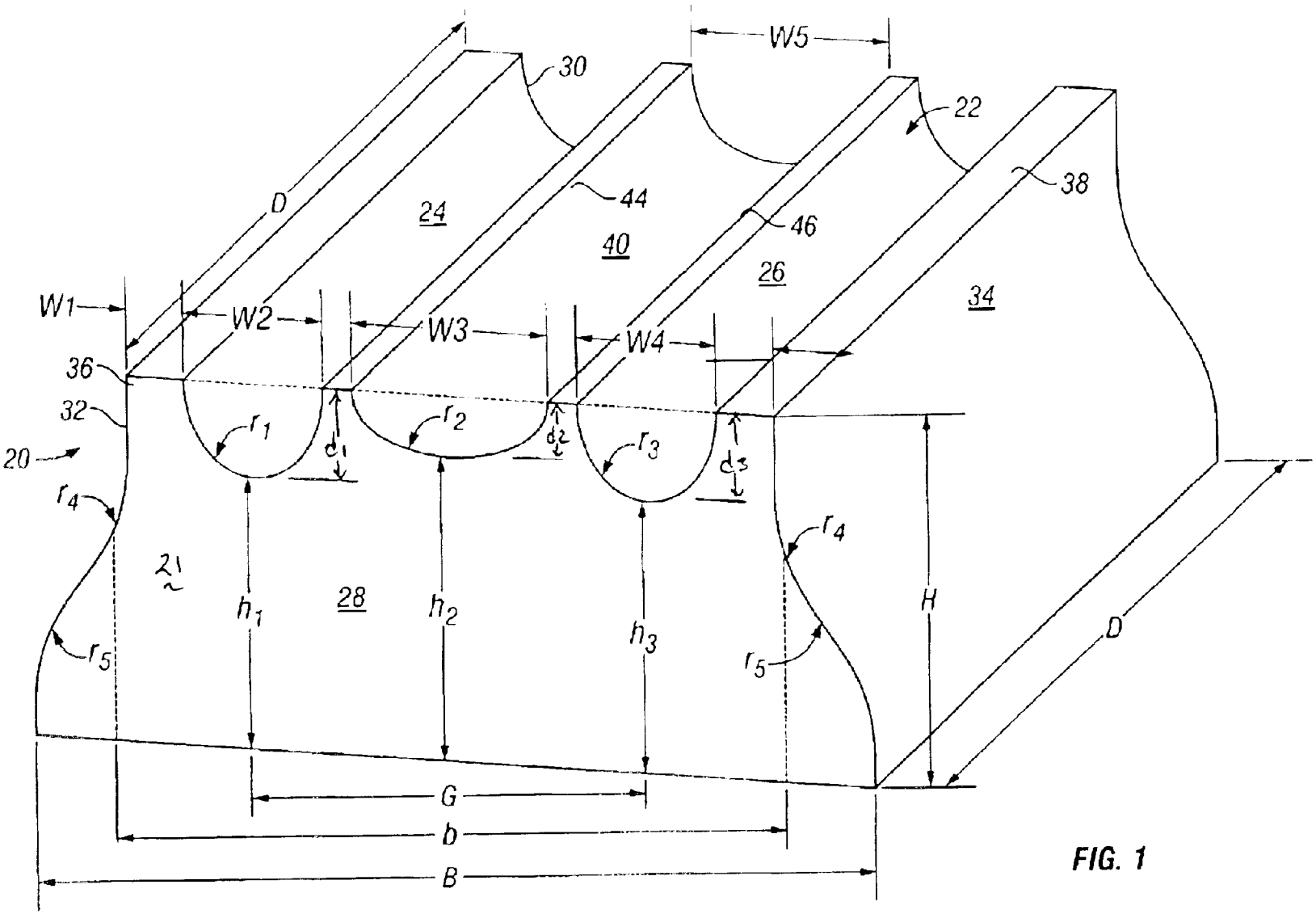
FIG. 1 shows a perspective view of a preferred embodiment of the cushioning device of the present invention.

FIG. 1 illustrates a perspective view of the cushioning device 20 of the present invention. As shown in FIG. 1, cushioning device 20 is preferably a unitary body formed of a cushioning material such as polyurethane foam (e.g., Omalux® foam of Carpenter Co. of Richmond, Va.). Various other materials are possible including alternate foam materials such as "High Resiliency", "Visco Elastic", and "Conventional" foams, non-foam materials such as natural rubbers, stuffed cushions such as a fabric outer layer encompassing fillers of polyester stable fibers or the like, fluid (e.g., liquid, air or viscous gel) inflated bodies with typically plastic (e.g. vinyl) exterior cover (with or without interior baffling) or any combination of the above. A solid block of foam material, as in the Omalux(t material above mentioned, is preferred, however, relative to ease in manufacturing the below described contoured support surface and for providing high comfort and feel within a reasonable size. The foam body can be used in direct contact with the user or have a cover of the like with or without intermediate filler material.

As explained in greater detail below, relative to size, the height of the contoured surface from the support surface is designed to provide a leg support level conducive to good blood flow conditions while maintaining a high comfort level.

In a preferred embodiment, a foam block (e.g. a molded body having the final desired configuration or a block that is subject to a contour process to form the desired resultant contoured body shape) such as of a polyurethane foam material is utilized. The foam relied upon is designed to provide a high degree of comfort while still achieving the desired level of support (preferably without bottoming out) at the desired height elevation off the underlying supporting surface (e.g. a coach or bed or floor). To facilitate a discussion of the preferred characteristics of the foam material of the present invention reference is made to the following preferred summaries of some quantitative values associated with foam material—

Indentation Force Deflection (IFD)—A measure of the load bearing capacity of flexible polyurethane foam. IFD is generally measured as the force (in pounds) required to compress a 50 square inch circular indentor foot into a 4 inch thick sample, typically 15 inches square or larger, to a stated percentage of the sample's initial height. Common IFD values are generated at 25 and 65 percent of initial height. (Reference Test Method ASTM D3574 ). Note: Previously called "ILD (Indentation Load Deflection)".

Compression Modulus—This is generally referred to as representing the ratio of a foam's ability to support force at different indentation (or compression) levels. It is determined by taking the ratio of the foam's IFD at 25% indentation and 65% indentation (65% IFD/25%). The compression modulus is typically a function of foam chemical formulation and the manufacturing process. In most cases, the higher the density the greater the compression modulus. Other terms that are used interchangeably are: support factor, and modulus.

Density—A measurement of the mass per unit volume. It is measured and expressed in pounds per cubic foot (pcf) or kilograms per cubic meter ($kg/m^3$) (Test Method ASTM D3547).

High Resilience (HR) Foam—A variety of polyurethane foam produced using a blend of polymer or graft polyols. High resilience foam has a less uniform (more random) cell structure different from conventional products. The different cell structure helps add support, comfort, and resilience or bounce. High resilience foams have a high support factor and greater surface resilience than conventional foams and are defined in ASTM D3770.

Hysteresis—The ability of foam to maintain original support characteristics after flexing. Hysteresis is the percent of 25% IFD loss measured as a compression tester returns to the normal (25% IFD) position after measuring 65% compression. Lower hysteresis values, or less IFD loss are desirable. Current research indicates that hysteresis values may provide a good indication of overall flexible foam durability. Low hysteresis in conventional foam is equal to less IFD loss.

Laminating—The bonding of layers of foam and/or other materials together into a single composite. This may be accomplished through adhesives or through heat processes like flame lamination.

Support Factor (see Compression Modulus)—represent 65% IFD/25% IFD determined after one minute of rest or recovery. When the support factor is known it can be used in conjunction with a known 25% IFD value to determine the 65% IFD value. Foams with low support factor are more likely to bottom out under load.

Relative to preferred embodiments of the present invention, Table 1 below provides some illustrative preferred characteristics for the foam material used in forming the below described contoured foam cushion which is preferably a High Resilience foam, Visco-elastic, or Conventional foam (e.g., Omalan® foam of Carpenter Co.)

TABLE 1

| Characteristic of polyurethane foam for use in the cushion of the present invention. | Preferred General Range Values | Preferred Intermediate Range Values | Preferred Value(s) |
|---|---|---|---|
| 25% IFD (lbs) | 15–55 | 20–50 | 30–40 |
| 65% IFD (lbs) | 30–165 | 40–150 | 60–120 |
| Compression Modulus | 1.8–4.0 | 2.1–3.8 | 2.5–3.4 |
| Density ($lbs/ft^3$) | 1.0–5 | 1.5–4 | 2–3 |

The cushioning device of the present invention is preferably designed to provide a proper level of support to a region of the leg extending from the interior of the heel to the closest end of the calf muscle. That is, in a preferred embodiment, the cushioning device (e.g. the upper leg contact region) has a depth D.

Figure 6:
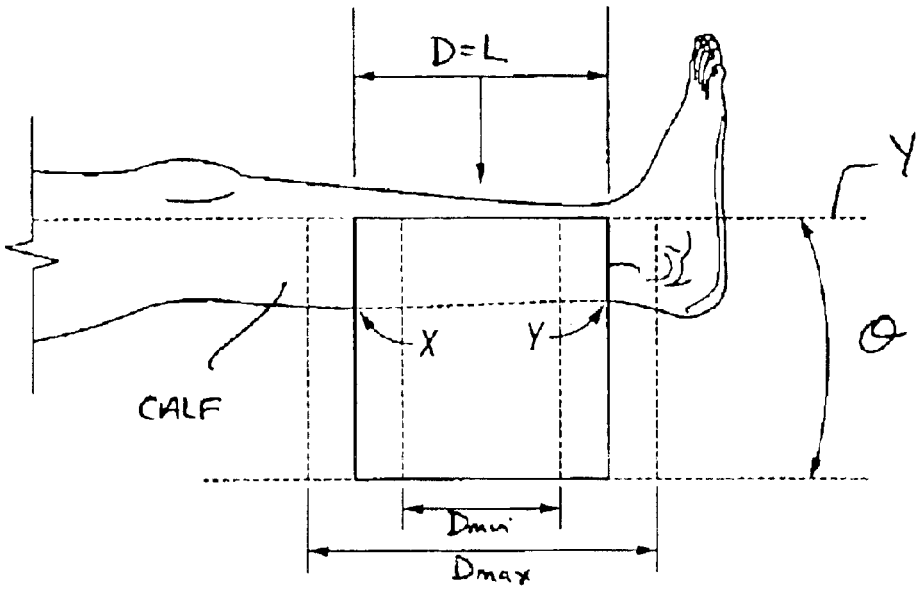
FIG. 6 shows a side elevational view of the cushion of the present invention in use.

For an average adult, the distance between the lower end of the calf muscle and the interior of the heel is 8 inches (20.3 cm) (hereafter preferred leg contact region L). In a preferred embodiment, cushion depth D is equal to that value or within (30%) (preferably in the lesser direction as in the greater direction contact with the heel and/or calf muscle slope occurs which can lessen the comfort level). Alternate arrangements represented by the present invention include providing contact regions to the heel and/or sloping calf muscle with the majority of contact (e.g. 70% or greater being relative to the noted preferred leg contact region L). The preferred leg contact arrangement thus has the heel unsupported by the upper contact surface and overhanging with preferably some back wall contact relative to the upper interior region of the heel overhang. This overhang relationship is illustrated in FIG. 6 and discussed in greater detail below.

As shown in FIG. 1, contoured support surface 22 includes recesses 24, 26 of depth $d_1$ and $d_3$ relative to the upper surface of cushion 20, which in the illustrated embodiment is represented by radius $r_1$ and $r_3$, respectfully. Recesses 24 and 26 are shown at opposite ends of main body 21 of cushion 20 in FIG. 1. End recesses 24 and 26 are illustrated as having width $w_2$ (e.g., $2\times r_1$) and width $w_4$ (e.g., $2\times r_3$), respectively. In a preferred embodiment recesses 24 and 26 are elongated, concave (e.g., semi-circular in cross-section) grooves that extend between opposite front and back end walls 28, 30. Thus, elongated grooves 24 and 26 preferably extend for length D so as open out at the front end rear faces provided by end walls 28 and 30.

Recesses 24 and 26 are spaced apart along the total width of the front face 28 of cushion 20 so as to provide for individual leg support, with the legs spread apart in a comfortable (natural) lying on back spacing. Preferably grooves or contours 24 and 26 are arranged parallel to one another. In view of the contouring nature of the cushioning material recesses, this parallel orientation can accommodate an acute angle leg relationship (e.g., a 5 to 30 degree angle which encompasses a typical or normal supine lying position).

In an alternate embodiment (not shown), grooves 24 and 26 are arranged in diverging fashion such as in the angle range noted above. The parallel arrangement is preferable, however, as it provides for use of either the "front" or "back" walls of cushion 20 at the heel end so as to avoid having the user have to flip the cushion around from an incorrect initial position. In a preferred embodiment, the separation distance G is from about 7 to 12 inches, with a preferred sub-range of 9 to 10 inches, being well suited for many intended uses for the present invention.

The depth $d_1$ and $d_3$ (or radius $r_1$ and $r_3$) are preferably of equal value with a range of 0.75-inches to 3-inches, sub-range 1.0-inch to 2.0-inches and value of 1.5-inches being illustrative of preferred dimensioning for the preferred invention. It should be noted that the term radius is being used in a broad sense as being the actual surface configuration or an average or approximation of, for example, a ridged or sub-level contouring (e.g. small peak/valleys, depressions, or stepped configurations). There is featured under the present invention a smooth semi-circular or approximate semi-circular arrangement (e.g. vertical side walls in the upper region followed by the concave curvature). In this latter case, depths $d_1$ and $d_3$ would be greater than $r_1$ and $r_3$ in view of the vertical walls at the upper end of the recesses.

Recesses 24 and 26 are further preferably positioned inward of end outer walls 32 and 34 of cushion 20. End projections 36 and 38 are preferably made of sufficient width ($w_1$, $w_4$) to maintain leg retention function (avoiding a bending out of outer walls 32 and 34 and rollout of a leg upon minor adjustments or rolling of a leg within grooves 24 and 26 by the user), while also minimizing material usage in product formation. A suitable thickness (average if any sloping in the inner and/or outer wall surface) for $w_1$ and $w_4$ is 0.50 to 1.50 with $w_1$ preferably equal to $w_4$ with 0.75 to 1.25 representing a preferred sub-range and 1 inch or 2.54 cm being a preferred value for many uses.

Cushion 20 also features a base width B which is greater than the width between the upper, exterior surface of end projections 36 and 38. Preferably base B has a length of 15 to 25, more preferably 17 to 20 and with 18 inches (45.7 cm) being an example of a suitable base length value. This provides a stable base relative to rocking or minor leg movements while the lessened width represented by (B-b) provides material usage minimization. This drop in width represented by (B-b) can be carried out in a variety of ways with FIG. 1 illustrated one example having a concave to convex curved end wall arrangement with the concave surface having radius $r_4$ leading to the convex surface with radius $r_5$. Rather than a concave/convex relationship other configurations can be utilized such as an outwardly sloping upper region (preferably assuming at least a majority of the overall height) followed by a different angled wall such as a vertical extension down from the sloping upper region. A preferred value for b is 12 to 22, more preferably 14 to 19 with 15.5 inches being well suited for many uses of the present invention.

The depth of grooves 24 and 26 ($r_1$, $r_2$ for the illustrated embodiment) are designed in relation to the overall height H of cushion 20 to provide maximum comfort through efficient usage of the IFD properties of the utilized foam such as those set forth above in Table 1. In a preferred embodiment H is 3 to 12, with 4 to 9 being illustrated of a preferred sub-range and 5.5 inches (14 cm) an example of a height that is well suited for the intended usage of the present invention.

The ratio $h_1/H$ or $h_3/H$ is preferably ⅙ to ⅚, more preferably ⅓ to ⅔ with a ratio of 3.5/5.5 being a well suited ratio for cushion heights as set out above and are well suited for IFD values of 25 to 45. Thus, with height values H as described above, some suitable $h_1$ and $h_3$ values are 1.0-inch to 5.0-inches, more preferably 2.0-inches to 4.0-inches, and a common height of 3.5 for $h_2$ and $h_3$ is well suited for providing sufficient support relative to the above noted preferred materials.

The above noted IFD value and height relatives can be achieved with foam material such as Omalon® foam material of Carpenter Co. Also, while the present invention is preferably a monolithic body of a common material, various laminates or multi-type cushion combinations are also encompassed by the present invention such as a base block together with a laminate layer or one or more recess inserts.

Figure 2:
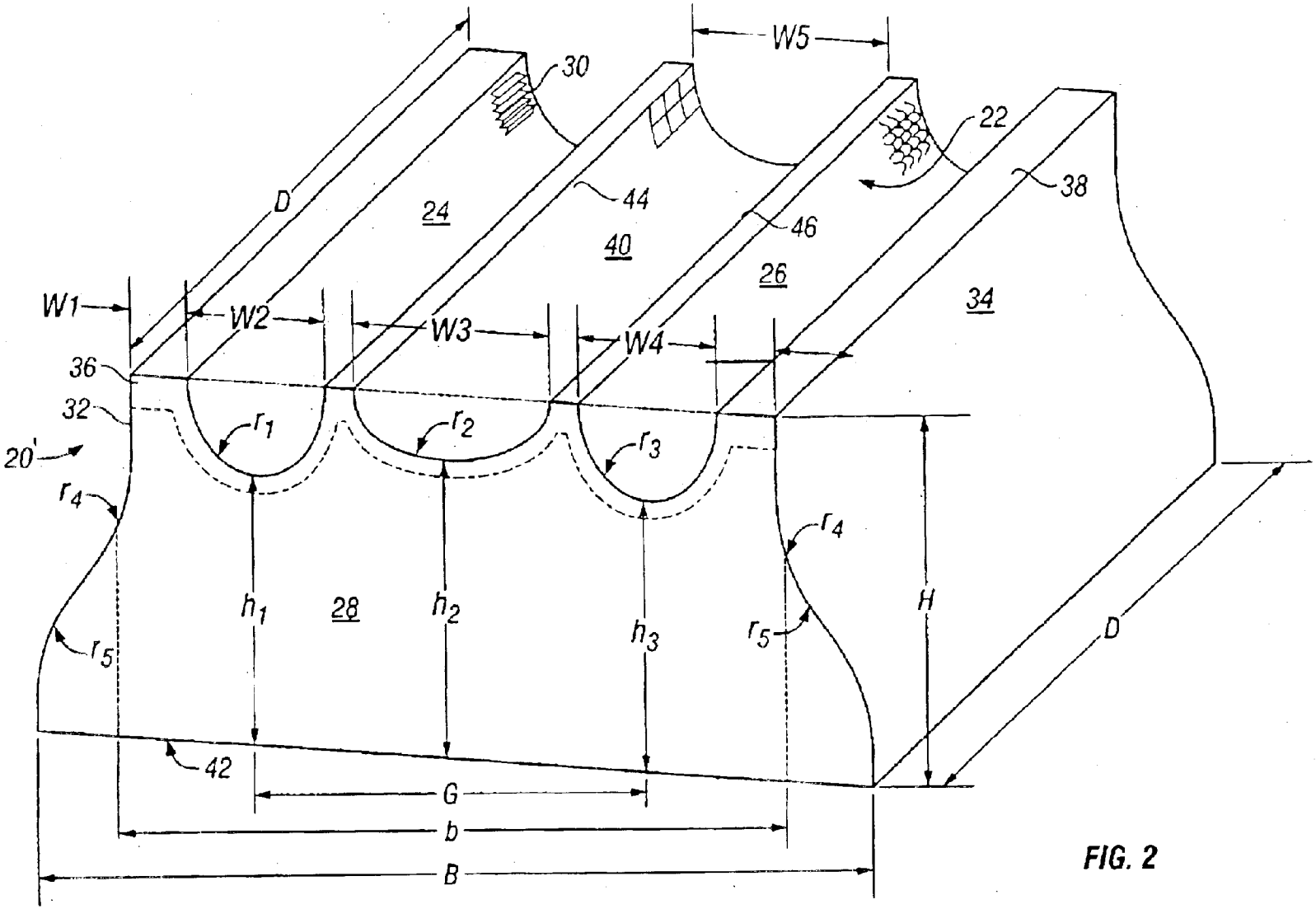
FIG. 2 shows a perspective view of an alternate embodiment of the present invention with an upper laminate layer.

FIG. 2 provides an illustration of a non-monolithic cushion embodiment 20' with an overall upper layer 38. Upper layer 38 is preferably of a material that has a different IFD value that is preferably, relative to base block 21 a less firm material or one having an IFD 25% value that is less than that of the base block by 25% to 75% so as to provide a softer initial surface contact feel. Upper leg contact layer 38 is preferably laminated in accordance with the above definition to permanently retain its position relative to base block 21, although removable embodiments such as by way of fasteners (preferably Velcro® fastener material). A covering can also be designed for use with the cushion in its entirety or for use with the upper laminate layer when utilized to avoid soiling of the foam base. An example of a suitable laminate combination includes an upper visco-elastic layer with one of the alternate foam materials providing the block or main body support below. The thickness of the upper laminate is preferably 0.25 to 2 inches range with 0.5 to 1 inch being a suitable sub range.

Figure 3:
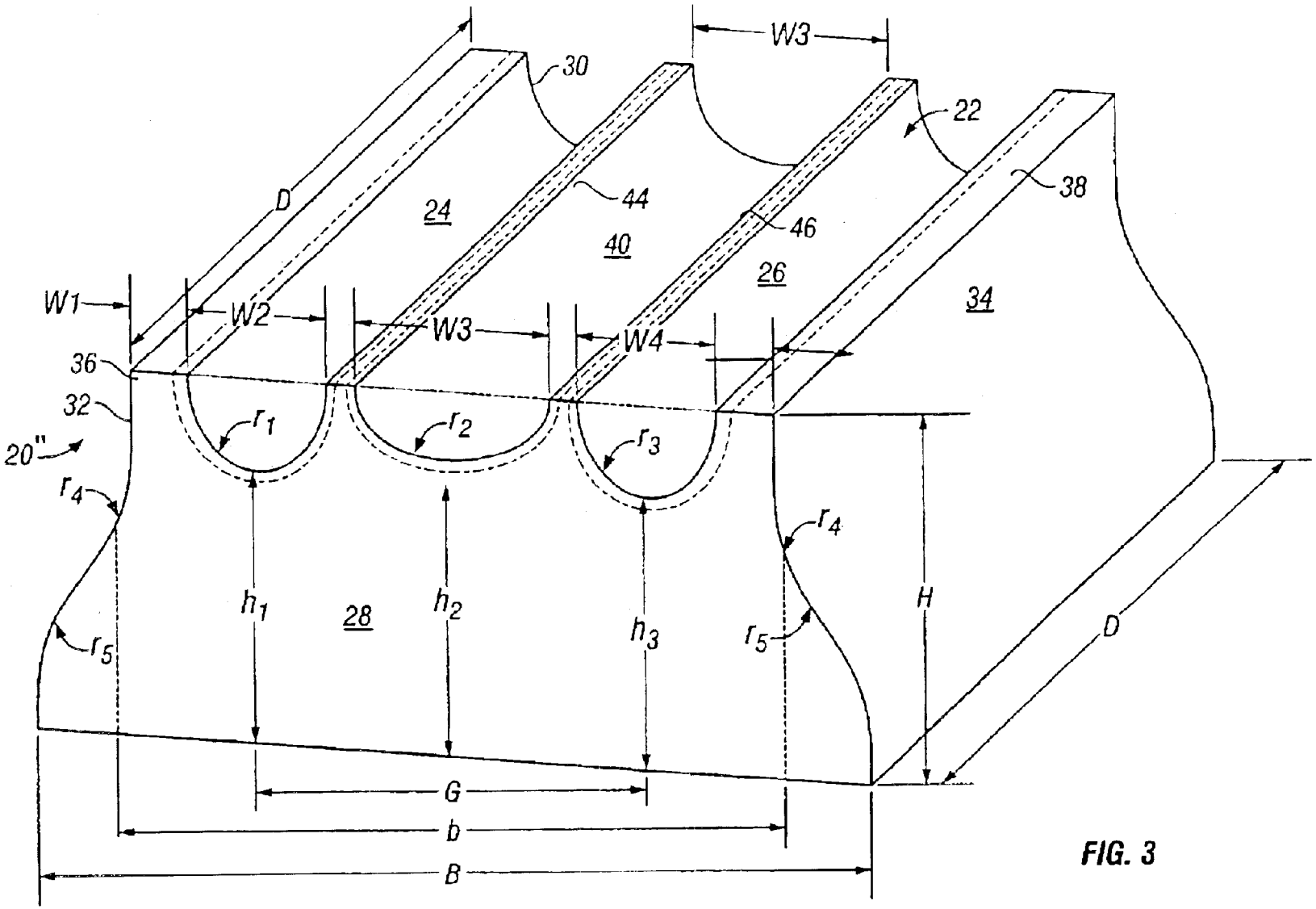
FIG. 3 shows a perspective view of another embodiment of the invention having recess inserts.

FIG. 3 illustrates an additional cushion embodiment 20" which features individual C-shaped cross-sectioned or otherwise recess conforming inserts that are provided within respective grooves 24 and 26 and preferably are fully covering. Like upper layer 38 above, inserts 25, 27 (the receiving pocket recess described in greater detail below) and 29 are preferably affixed to the base 21.

As with the above noted, visco-elastic foam material can be utilized for the upper layer 38 or for the pocket inserts 25, 27, and 29. A visco-elastic foam is also made by Carpenter Co. of Richmond, Va. under the trademark VISCOLUX foam and CONFORM foam. Visco-elastic foam is a high density, visco-elastic, open-cell material. The open-cells are generally spherical with windows and are temperature and weight sensitive (becoming softer upon being heated such as by body heat). When a visco-elastic material is utilized as a laminate or insert under the present invention, the preferred density range is 16 to 120 kg/m$^3$, more preferably 16–95 kg/m$^3$, with 30–60 kg/m$^3$ and 40–45 kg/m$^3$ being preferred sub-ranges. A hardness ranging from 25 to 90N at 25% compression at 20° C. represents a preferred hardness range with 30 to 40N being a preferred sub-range and 35N a preferred value therein. It is also noted that a preferred hardness range of 10N to 60N is applicable at 65% compression at 20° C.

If a polyurethane foam (as the base support—and/or upper laminate or inserts) (a density 25 to 50 kg/m$^3$ and hardness range of 10 lbs to 30 lbs) is suitable for both "conventional" and high resiliency materials including densified polyurethane foam such as Omalan® or Hypersoft® foam of Carpenter Co. or high-resiliency foam such as QUALATEX® foam of Carpenter Co.

Figure 5:
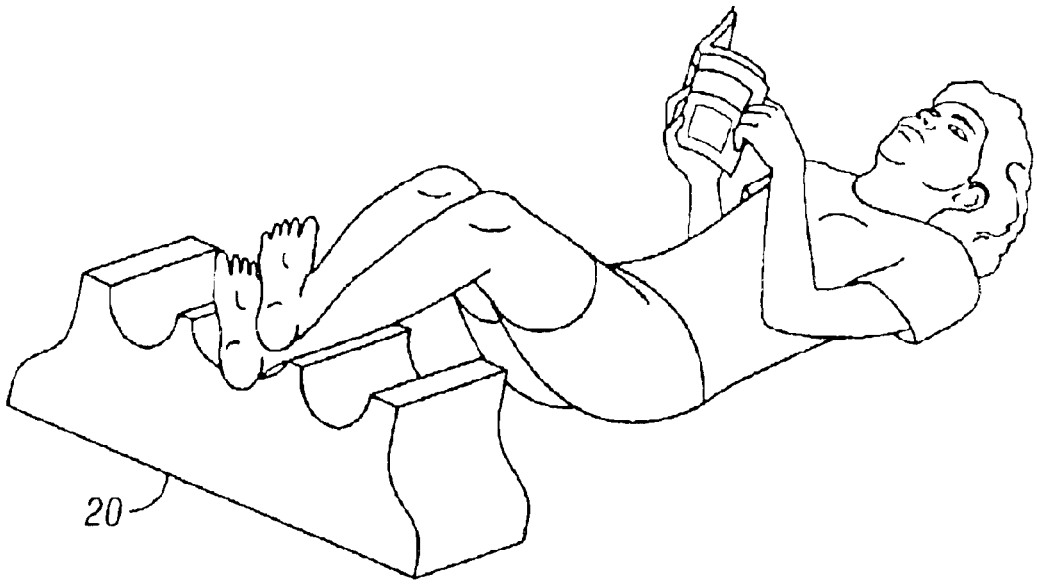
FIG. 5 shows a user in a supine position with legs in a crossed relationship and supported by the cushion of the present invention.

FIGS. 1–3 illustrate an additional feature of the present invention which comprises a third contoured surface portion which is shown as elongated groove or recess 40 in each of the figures. Recess 40 is preferably of a different dimension or configuration relative to recesses 24 and 26 in providing a preferred location for supporting a user's crossed leg arrangement which is another common leg position assumed by a person lying on his/her back. FIG. 5 is illustrative of cushion 20 being used in a cross-leg context. Because a crossed-leg pair places a greater load relative to the underlying area of surface contact, the load support characteristics there below is preferably different than that for grooves 24 and 26. In a preferred embodiment, the greater load is accommodated by making the height $h_2$ of a greater value than $h_1$ and $h_3$ for the single leg grooves 24 and 26, although other arrangements are also possible, e.g., a common recess depth for all three but with an insert (or different) insert in the crossed-leg recess or a laminate that runs laterally rather than height-wise to place a foam having higher IFD's characterizing below the cross-over leg support. Also, while the preferred embodiment features recesses with defining side walls, additional embodiments of the invention include recess free arrangements (planar across surface) preferably still however, with the end projections to avoid leg roll off and/or preferably with different foam IFD characteristics in the applicable support regions. The embodiment with individual, opposite wall or projections defined recesses is, however, preferred in helping to provide proper leg positioning and user comfort.

In FIG. 1, there is illustrated height $h_2$ being relatively greater than $h_1$ and $h_3$ such as a value 5 to 25% greater (e.g. 12.5% or greater) than the preferably common value for heights $h_1$ and $h_3$. This increase in height can be achieved by a less depth groove 40 relative to a common planar base support surface 42, producing for example, an increase from 3.5 to 4.0 inches in going from $h_1$ or $h_3$ to $h_2$. The lessening in height can be accommodated by having a greater radius value $r_2$ which has a center point above the upper surface to provide less than a full half circle so as to provide for a greater width $w_5$ relative to the end widths $w_2$ and $w_4$. This greater width of 3-inches to 8-inches helps accommodate the wider leg space occupation of the two crossed over legs as shown in FIG. 5. A sub-range of 4-inches to 6.5-inches for $w_5$ is also suitable with a preferred value 5 inches for many cushion configurations and materials under the present invention.

In a preferred embodiment, groove 40 is in an intermediate position relative to groove 24 and 26 although other arrangements such as the crossed leg groove being provided at one end of cushion 20 to one side of individual leg grooves 24 and 26, are featured under the present invention.

In addition to groove 40 preferably being centered relative to grooves 24 and 26, it is also preferably centrally positioned relative to the upper portion of opposite far end walls 32 and 34 (with grooves 24 and 26 being preferably equally inwardly spaced from those end walls and equally spaced from the intermediate groove 40). FIG. 1 illustrates further projections 44 and 46 spacing groove 40 from respective grooves 24 and 26 with $w_2$ and $w_3$ preferably being from 0 (see the above discussion for a planar upper surface with or without different conforming foam material) to 2.0-inches in thickness (average thickness if sloped walls involved) with a preferred sub-range of 0.25-inch to 1.0-inch and a preferred value of 0.5 of an inch. As with end projections 36, 38, projections or dividers 44, 46 are designed to be thick enough to ensure leg capture without easy roll out in normal usage, but are minimized to minimize the amount of material usage. Also, since a roll out of the intermediate groove 40 of a leg would result in less drastic a drop than from an end roll up, the interior projection widths $w_2$ and $w_3$ can be made thinner than the end projections. Groove 40 is preferably positioned parallel with dividers 44, 46, end projections 36, 38 and grooves 24 and 26.

FIGS. 2 and 3 illustrate a similar arrangement as in FIG. 1, but with upper layer 38 extending as an upper laminate layer for groove 40 as well as the above noted end grooves in FIG. 2. FIG. 3 illustrates individual cross-over leg insert 27 for recess 40 which can be of the same or different IFD value (e.g. a material having higher 25% and/or 65% IFD value as compared to inserts 25 and 29 but a lesser value for at least one of the two categories relative to the base body 21).

The height values for $h_1$ and $h_2$ are designed to lift the leg of a user at an angle of about 5 to 40° (e.g. sine of σ shown in FIG. 6 with the usage height X (i.e. after full compression by the legs) or more preferably 10 to 30°, or even more preferably an angle of 15 to 25° with 20° being a preferred representative value. The hypotenuse Y in FIG. 6 is representative of an average adult leg length.

Also, while the cushion 20 of the present invention is shown with a horizontal upper contact surface, a prefabricated upper slope (calf to heel direction) of 0 to 20° is also encompassed with the present invention. A horizontal upper contact surface is preferred as for most type of cushion material the leg slope can be accommodated by the compression accommodate range of the cushion material and it facilitates some of the possible manufacturing techniques.

FIG. 6 illustrates depth D of cushion 20 to be essentially commensurate with length L (i.e. L=D). FIG. 6 also shows by dashed lines some illustrative variations made in depth D of cushion 20 through use of dashed lines which can either be considered to be applicable at one end and not the other or illustrative of variations for each end with each end either being in a positive (greater block depth length) or negative ( a reduction in block length). In the former case Dmax is illustrative while in the latter case $D_{min}$ is illustrative. Suitable values for D include 4-inches to 12-inches, more preferably 6-inches to 10-inches and with 8 inches being well suited for many users. Preferably $D_{max}$ and $D_{min}$ are within 30% of the D value so as to provide a typical ΔD value in the positive or negative direction and applicable to either end.

FIG. 2 further illustrates examples of groove surface contouring or cushion sub-contour formations 31, 33 and 35 for the leg contact surface in the grooves. These sub-contour formation can help lessen surface contact with the user and promote better air circulation, with the embodiment shown including a longitudinal ridged configuration 31 (although other ridge configuration including ridges running obliquely or laterally or in a combination such as a zigzag pattern are also encompassed under the present invention). Sub-contouring 33 is illustrative of a checkerboard configuration with diagonally opposed depressions adjacent flat surface. Sub-contour formation 35 is illustrative of a peak and valley or egg crate configuration contact surface which can include the same pattern or patterns with increased height areas (e.g., conforming to the height spacing relative to the leg contour). Various combinations of the above and alternate projection/recess sub-contour surfacing is also applicable under the present invention.

A variety of manufacturing techniques can be utilized to form cushion 20 including contour cutting (e.g., moving wire blades, roller with knife, heated cutting blades, etc.) or through a molding technique such as where foam precursor chemicals or expandable particles is/are injected into, for example, a two part mold container.

Figure 4:
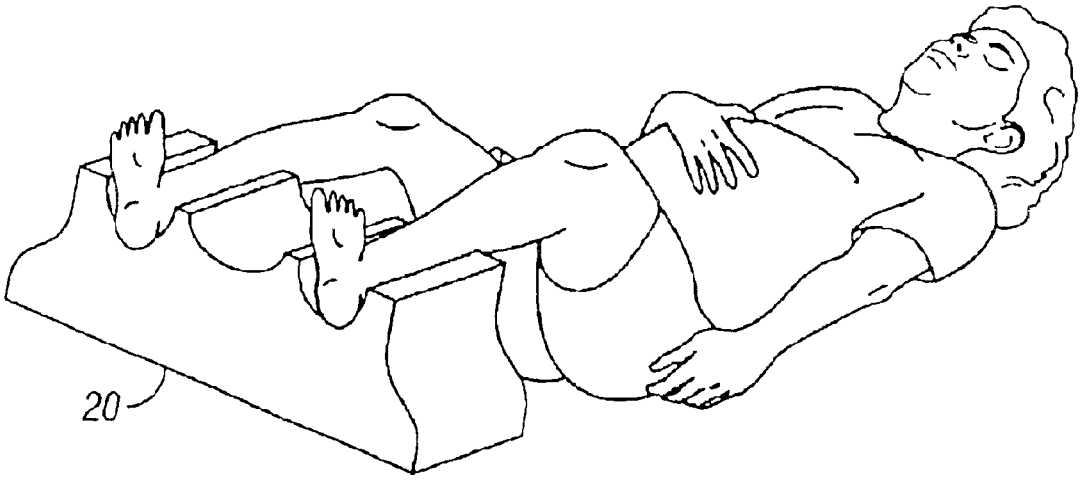
FIG. 4 shows a user in a supine position with legs in a spaced apart, non-crossed relationship supported by the cushion of the present invention.
Figure 7:
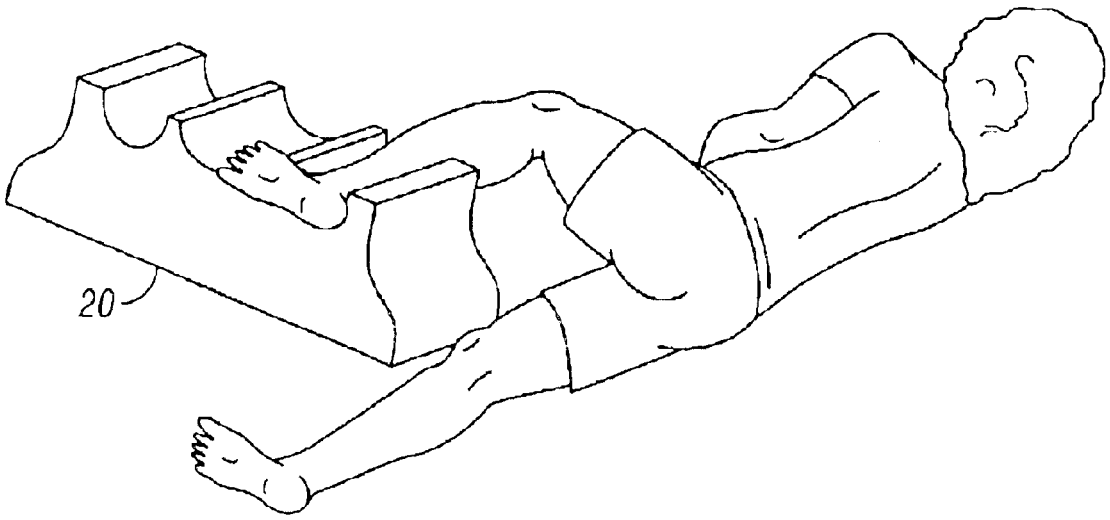
FIG. 7 shows a user in a lateral position with leg supported by a cushion of the present invention.

Also, FIGS. 4, 5 and 7 illustrate that a person's leg can either be bent (with an inwardly positioned buttocks) or generally falling along a common downwardly sloped line as depicted in FIG. 7.

While the invention has been described in detail with reference to specific embodiments thereof, it will be apparent to one skilled in the art that various changes and modifications can be made, and equivalents employed, without departing from the scope of the appended claims.

What is claimed is:

1. An elevating foot cushion, comprising:

a unitary foam body defining front and rear faces and left and right lateral faces and an upper leg contact surface, said upper leg contact surface comprising first, second, and third laterally spaced apart leg reception recesses that extend in a leg extension direction between said front and rear faces and an intermediate foam body region extending between said spaced apart first and second leg reception recesses.

2. The cushion of claim 1 wherein said cushion has a height which is less than 6 inches and a depth which is less than 9 inches.

3. The cushion of claim 1 wherein said third leg reception recess is positioned laterally between said first and second leg reception recesses.

4. The cushion of claim 1 wherein said third leg reception recess is positioned in the intermediate foam body region.

5. The cushion of claim 4 wherein a portion of said intermediate foam body region below said third leg reception recess has a greater load support characteristic as compared to that portion of the foam body underlying said first and second leg reception recesses.

6. The cushion of claim 5 wherein a height of foam material underlying the third leg reception recess is greater than that underlying said first and second leg reception recesses.

7. The cushion of claim 6 wherein said third reception recess is shallower in depth compared to a depth of said first and second leg reception recesses.

8. The cushion of claim 1 wherein said third leg reception recess is wider in lateral dimension than said first and second leg reception recesses for accommodating a crossed-leg set.

9. The cushion of claim 8 wherein said third leg reception recess is shallower in depth than said first and second leg reception recesses.

10. The cushion of claim 1 wherein said cushion is defined by a single block of foam with upper surface contouring in said foam block defining said upper leg contact surface.

11. The cushion of claim 10 wherein said intermediate foam body region extends between said first and second leg reception recesses and has a vertical thickness which is equal to or greater than a foam thickness directly underlying said first and second leg reception recesses at all points laterally between said first and second leg reception recesses.

12. The cushion of claim 11 wherein the vertical thickness of said intermediate foam body region is greater than the foam thickness directly underlying said first and second leg reception recesses.

13. The cushion of claim 12 wherein said third leg reception recess is formed in said intermediate foam body region.

14. The cushion of claim 1 wherein said first and second leg reception recesses open out at both the front and rear faces.

15. The cushion of claim 14 wherein said third leg reception recess opens out at said front and rear faces.

16. The cushion of claim 1 wherein said third leg reception recess has a crossed-leg reception profile which is different in cross-section than said first and second leg reception recesses.

17. The cushion of claim 16 wherein each of said first, second and third leg reception recesses include a semi-cylindrical contour.

18. The cushion of claim 17 wherein the third reception recess depth is less than that of said first and second leg reception recesses and said third reception recesses has a greater width than said first and second leg reception recesses.

19. The cushion of claim 1 wherein said upper leg contact surface includes a pair of outer wall projections which define an exterior side of said first and second leg reception recesses.

20. The cushion of claim 19 wherein said upper leg contact surface includes a pair of interior wall projections which define wall surfaces in each of said first, second and third reception recesses.

21. The cushion of claim 1 wherein said first and second leg reception recesses are recesses that are elongated for a length which is 8 inches ±30% of a dimension L representing a minimum length between a calf and a heel of a user.

22. The cushion of claim 21 wherein the cushion depth is equal to or less than L.

23. A foot elevating cushion comprising a cushion body having a pair of individual leg reception cavities in an upper region of the cushion body and a cross-leg reception cavity in an upper region of the cushion body, wherein said cross-leg reception cavity overlies a thicker region of said cushion as compared with an underlying region below said individual leg reception cavities.

24. The foot elevating cushion of claim 23 wherein said cross leg reception cavity is wider in width than said first and second leg reception cavities.

25. The foot elevating cushion of claim 23 wherein said cross-leg reception cavity has a different configuration than said individual leg reception cavities.

26. The foot elevating cushion of claim 23 wherein said cushion is a unitary foam body.

27. The foot elevating cushion of claim 26 wherein said unitary foam body is defined by a monolithic block of foam.

28. The foot elevating cushion of claim 27 wherein said unitary foam body includes an upper laminate defining a leg contact region.

29. A foot elevating cushion, comprising:

a cushion body having a front face and a rear face and an upper leg support surface, said upper leg support surface including first and second portions which have a first support characteristic designed for supporting an individual leg, and said upper leg support surface also including a third portion having a different support characteristic than said first and second portions which is more adept at handling a higher load pair of crossed legs, wherein said first, second and third portions are defined by recesses formed in said upper contact surface and laterally spaced from each other.

30. The cushion of claim 29 wherein said cushion is a foam body which features a solid base section extending between left and right lateral sides and having a thicker region in an intermediate region underlying said third portion.

31. The cushion of claim 29 wherein said first, second and third portions are recesses that are elongated for a length which is within 8 inches ±30% of a dimension L representing a minimum length between a calf and a heel of a user.

32. The cushion of claim 31 wherein the cushion depth is equal to or less than L.

33. A foot elevating cushion, comprising:

a cushion body having a front face and a rear face and an upper leg support surface, said upper leg support surface including first and second portions which have a first support characteristic designed for supporting an individual leg, and said upper leg support surface also including a third portion having a different support characteristic than said first and second portions which is more adept at handling a higher load pair of crossed legs, wherein said cushion is a foam body which features a solid base section extending between left and right lateral sides and having a thicker region in an intermediate region underlying said third portion.

34. The cushion of claim 33 wherein said first, second and third portions are recesses that are elongated for a length which is 8 inches ±30% of a dimension L representing a minimum length between a calf and a heel of a user.

35. The cushion of claim 33 wherein the cushion depth is equal to or less than L.

* * * * *